US009880491B1

(12) United States Patent
Makita et al.

(10) Patent No.: US 9,880,491 B1
(45) Date of Patent: Jan. 30, 2018

(54) IMAGE FORMING APPARATUS AND BEARING

(71) Applicant: FUJI XEROX CO., LTD., Tokyo (JP)

(72) Inventors: Shota Makita, Kanagawa (JP); Shinichi Oba, Kanagawa (JP); Mutsumi Kikuchi, Kanagawa (JP); Nao Kato, Kanagawa (JP); Iori Togu, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/434,352

(22) Filed: Feb. 16, 2017

(30) Foreign Application Priority Data

Sep. 28, 2016 (JP) ..... 2016-189095

(51) Int. Cl.
*G03G 15/08* (2006.01)

(52) U.S. Cl.
CPC ..... *G03G 15/0813* (2013.01)

(58) Field of Classification Search
CPC ..... G03G 15/0813
USPC ..... 399/279
See application file for complete search history.

(56) References Cited

U.S. PATENT DOCUMENTS

2010/0111569 A1* 5/2010 Kakitani ..... G03G 15/0813 399/236
2014/0314439 A1* 10/2014 Yasui ..... G03G 15/0898 399/103
2014/0369720 A1* 12/2014 Ogino ..... G03G 15/0813 399/267

FOREIGN PATENT DOCUMENTS

JP 2001-083858 A 3/2001
JP 2006-330676 A 12/2016

* cited by examiner

*Primary Examiner* — Sandra Brase
(74) *Attorney, Agent, or Firm* — Sughrue Mion, PLLC

(57) ABSTRACT

Provided is an image forming apparatus including an image carrier on which a latent image is developed, a developing roller that is provided to face the image carrier to perform development for the latent image of the image carrier, an urging unit that urges the image carrier and the developing roller so that the image carrier and the developing roller approach each other, and a distance regulating unit that includes a viscoelastic body that is deformed according to a change of a distance between the image carrier and the developing roller, and regulates at least one of a maximum value of the distance between the image carrier and the developing roller and a minimum value of the distance between the image carrier and the developing roller so that the distance between the image carrier and the developing roller falls within a predetermined range.

18 Claims, 6 Drawing Sheets

IMAGE FORMING APPARATUS AND BEARING

CROSS-REFERENCE TO RELATED APPLICATIONS

This application is based on and claims priority under 35 USC 119 from Japanese Patent Application No. 2016-189095 filed Sep. 28, 2016.

BACKGROUND

Technical Field

The present invention relates to an image forming apparatus and a bearing.

SUMMARY

According to an aspect of the invention, there is provided an image forming apparatus including:

an image carrier on which a latent image is developed;

a developing roller that is provided to face the image carrier to perform development for the latent image of the image carrier;

an urging unit that urges the image carrier and the developing roller so that the image carrier and the developing roller approach each other; and a distance regulating unit that includes a viscoelastic body that is deformed according to a change of a distance between the image carrier and the developing roller, and regulates at least one of a maximum value of the distance between the image carrier and the developing roller and a minimum value of the distance between the image carrier and the developing roller so that the distance between the image carrier and the developing roller falls within a predetermined range, wherein the distance regulating unit includes:

a side plate in which a guide hole is formed into which a portion of the developing roller is inserted, the guide hole guiding the developing roller so that the developing roller is movable in a direction toward or away from the image carrier, and a bearing that supports the developing roller to be movable in a direction toward or away from the image carrier as well as to be rotatable, and is provided on the side plate, and wherein the viscoelastic body is provided in the bearing.

BRIEF DESCRIPTION OF THE DRAWINGS

Exemplary embodiments of the present invention will be described in detail based on the following figures, wherein:

FIGS. 4A and 4B are views illustrating an operation of a distance regulating mechanism used in the first exemplary embodiment of the present invention, in which FIG. 4A is a view illustrating the distance regulating mechanism when a distance between an image carrier and a developing roller is minimized, and FIG. 4B is a view illustrating the distance regulating mechanism when a distance between the image carrier and the developing roller is maximized;

FIGS. 5A and 5B are views illustrating a bearing used in the exemplary embodiment of the present invention, in which FIG. 5A is a first perspective view, and FIG. 5B is a second perspective view.

DETAILED DESCRIPTION

Hereinafter, an exemplary embodiment of the present invention will be described in detail with reference to the accompanying drawings.

Figure 1:
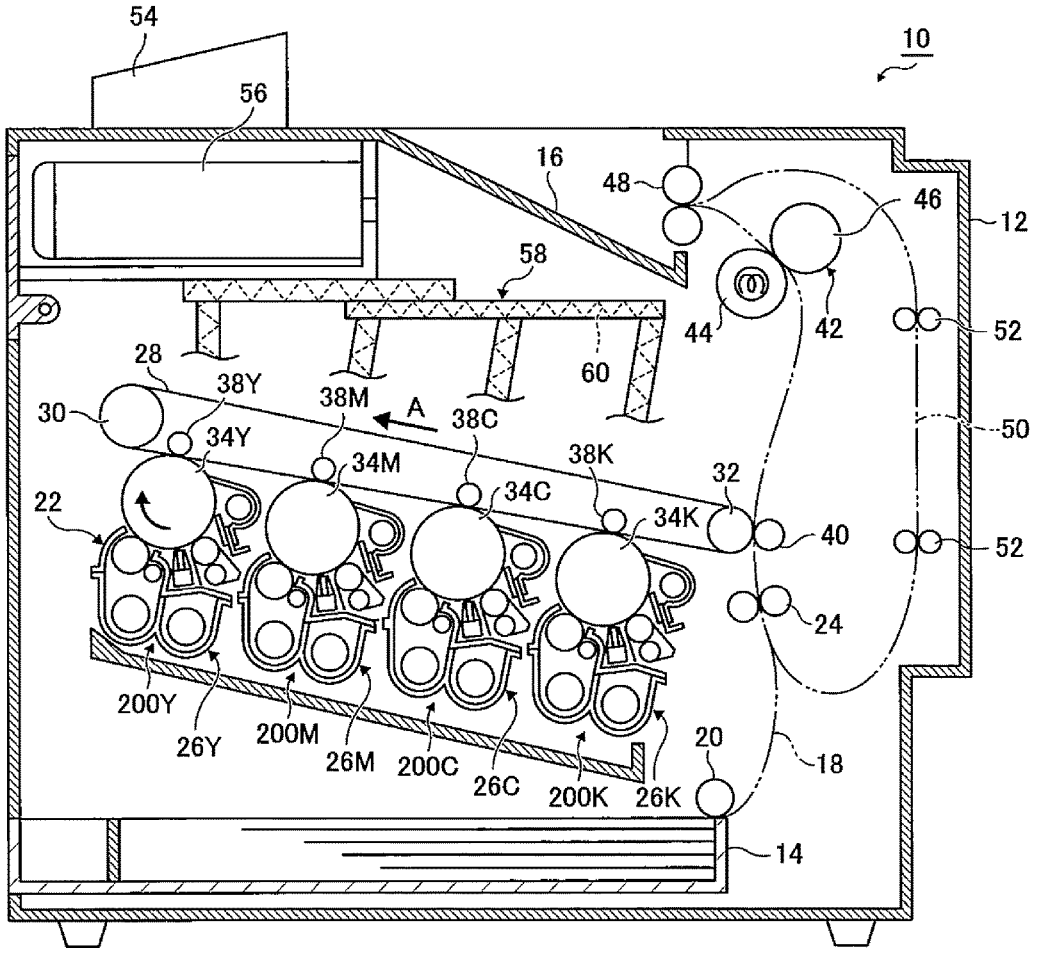
FIG. 1 is a sectional view illustrating an image forming apparatus according to a first exemplary embodiment of the present invention, when viewed from the front side.

FIG. 1 is a view illustrating a configuration of an image forming apparatus 10 according to a first exemplary embodiment of the present invention.

The image forming apparatus 10 includes an image forming apparatus body 12. A sheet accommodating unit 14 is provided at a lower portion of the image forming apparatus body 12, and a sheet discharge unit 16 is provided at an upper portion of the image forming apparatus body 12. Plural sheets are accommodated in the sheet accommodating unit 14. A sheet path 18 is formed extending from the sheet accommodating unit 14 to the sheet discharge unit 16.

The sheet placed at the uppermost position of the sheet accommodating unit 14 is fed by a pickup roller 20. The fed sheet is temporarily stopped by registration rollers 24 to be positioned and regulated, and is transported toward a secondary transfer roller 40 to be described later at a predetermined timing.

An image forming unit 22 is provided at the center portion of the image forming apparatus body 12. The image forming unit 22 includes, for example, four image forming units 26Y, 26M, 26C, and 26K. The image forming units 26Y, 26M, 26C, and 26K are provided to correspond to respective colors of yellow (Y), magenta (M), cyan (C), and black (K), and are arranged along an intermediate transfer belt 28 at equal intervals. The intermediate transfer belt 28 is supported by, for example, two support rollers 30 and 32, and rotates in the direction of the arrow A.

The image forming units 26Y, 26M, 26C, and 26K include photoconductor drums 34Y, 34M, 34C, and 34K each of which is an image carrier, and developing devices 200Y, 200M, 200C, and 200K, respectively. The photoconductor drums 34Y, 34M, 34C, and 34K face primary transfer rollers 38Y, 38M, 38C, and 38K across the intermediate transfer belt 28, and developer images formed by the primary transfer rollers 38Y, 38M, 38C, and 38K in the image forming units 26Y, 26M, 26C, and 26K are primarily transferred to the intermediate transfer belt 28.

The secondary transfer roller 40 faces the support roller 32 across the intermediate transfer belt 28. By the secondary transfer roller 40, the primarily transferred developer image is secondarily transferred to the sheet transported through the sheet path 18.

The sheet to which the developer image is secondarily transferred is transported to a fixing device 42. The fixing device 42 is a device that fixes a toner image transferred to the sheet, on the sheet by, for example, heat and pressure, and includes, for example, a heating roller 44 and a pressure roller 46. The sheet on which the developer image is fixed by the fixing device 42 is discharged to the sheet discharge unit 16 by discharge rollers 48.

The image forming apparatus 10 further includes a reverse transport path 50. The reverse transport path 50 is a transport path that reverses a sheet having the developer image formed on one surface thereof, and transports the sheet to the upstream side of the registration rollers 24 in the sheet path 18. For example, two transport rollers 52 are disposed along the reverse transport path 50, and the sheet fed to the reverse transport path 50 from the discharge rollers 48 is transported to the sheet path 18 by the transport rollers 52.

The image forming apparatus 10 further includes a UI device 54. The UI device 54 is provided, for example, on the top of the image forming apparatus body 12. The UI device 54 is configured by combining, for example, a liquid display device and a touch panel-type information input device, and allows an operator to input setting information for image formation or displays information to the operator.

The image forming apparatus 10 further includes developer containers 56 corresponding to the number of the developing devices 200Y, 200M, 200C, and 200K. A developer (toner) is contained in each of the developer containers 56. The developer containers 56 are detachably mounted to the image forming apparatus body 12, for example, in the upper portion of the image forming apparatus body 12.

The image forming apparatus 10 further includes a developer transport device 58. The developer transport device 58 transports developers of respective colors contained in the developer containers 56 to the corresponding developing devices 200Y, 200M, 200C, and 200K. A transport member 60 formed in a spiral shape is provided in the developer transport device 58. When the transport member 60 is rotated, the developers are transported from the developer containers 56 to the developing devices 200Y, 200M, 200C, 200K, respectively.

Figure 2:
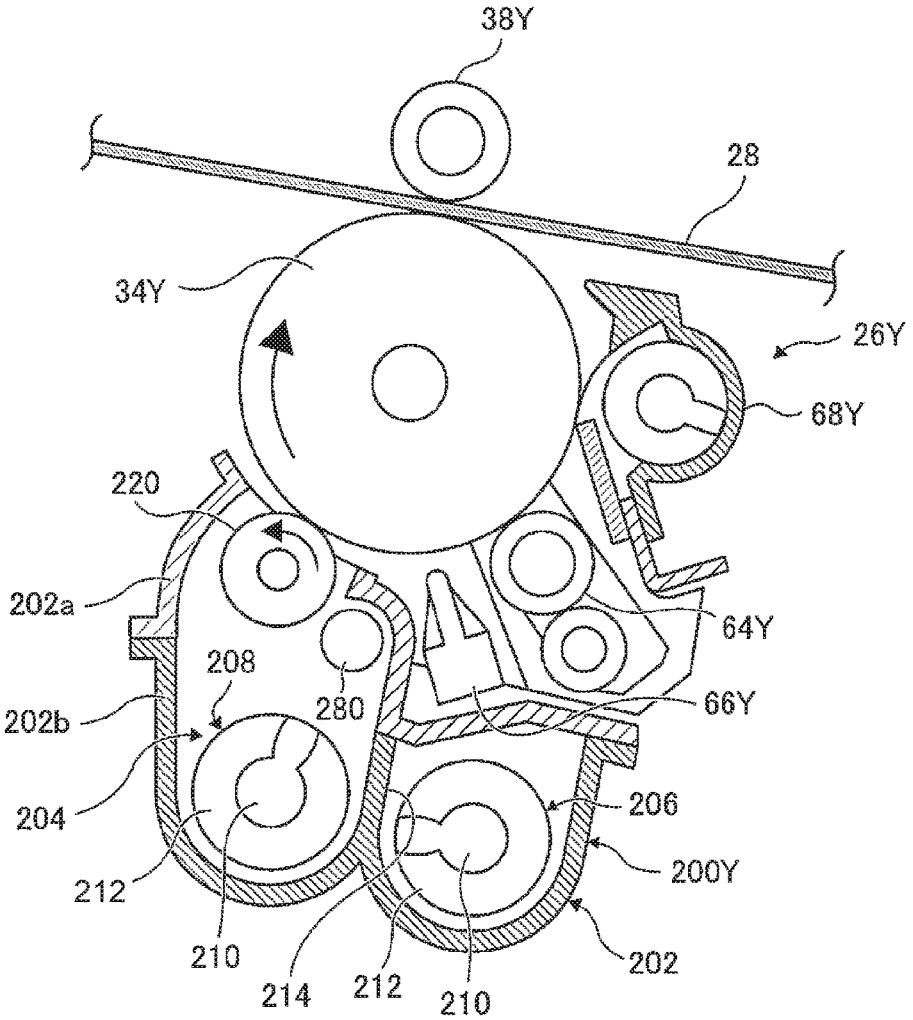
FIG. 2 is a sectional view illustrating an image forming unit used in the first exemplary embodiment of the present invention, when viewed from the front side.

In FIG. 2, the image forming unit 26Y for yellow is illustrated as an example of the image forming unit 26. Meanwhile, configurations of other image forming units 26M, 26C, and 26K are the same as that of the image forming unit 26Y for yellow, and thus descriptions thereof will be omitted.

The image forming unit 26Y includes, in addition to the photoconductor drum 34Y and the developing device 200Y as described above, a charging device 64Y that charges the photoconductor drum 34Y, a latent image forming device 66Y that irradiates the surface of the photoconductor drum 34Y charged by the charging device 64Y with light to form a latent image on the surface of the photoconductor drum 34Y, and a cleaning device 68Y that cleans the photoconductor drum 34Y by removing a toner, or the like remaining on the photoconductor drum 34Y after a toner image is transferred to the intermediate transfer belt 28 by the primary transfer roller 38Y.

The developing device 200Y is a two-component developing device that uses a toner and a carrier for development. The developing device 200Y includes a developing device side casing 202. The developing device side casing 202 is formed by joining an upper member 202*a* to a lower member 202*b*. A developer circulation path 204 is formed at the lower portion of the developing device side casing 202. A first developer transport member 206 and a second developer transport member 208 are disposed in the developer circulation path 204. Each of the first developer transport member 206 and the second developer transport member 208 includes a rotating shaft 210, and a spiral agitation transport unit 212 formed around the rotating shaft 210. The first developer transport member 206 and the second developer transport member 208 are spaced apart from each other by a partition wall portion 214 formed in a central longitudinal direction. Openings (not illustrated) are formed at both sides in the longitudinal direction of the partition wall portion 214. Through the openings, a developer is circulated in the developer circulation path 204.

A developer supply port (not illustrated) is formed at the developing device side casing 202 to be connected to the developer circulation path 204. From the developer supply port, a new toner is supplied through the developer transport device 58 from the developer container 56 as described above.

The developing device 200Y includes a developing roller 220. The developing roller 220 is provided to face the photoconductor drum 34Y to develop the latent image on the photoconductor drum 34Y. A layer thickness regulating member 280 is provided at the upstream side of a developing area facing the photoconductor drum 34Y. The layer thickness regulating member 280 regulates a layer thickness of a magnetic brush formed on the developing roller 220. Then, the developer with a layer thickness regulated by the layer thickness regulating member 280 is supplied to the developing area to form a toner image on the photoconductor drum 34Y.

Figure 3:
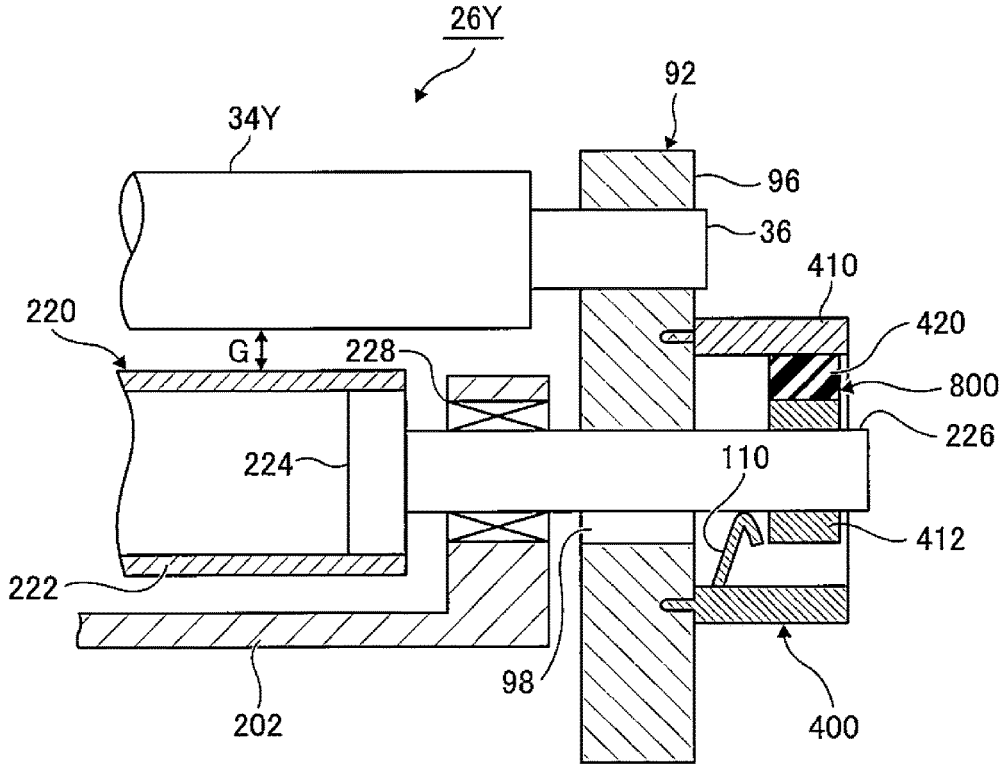
FIG. 3 is a sectional view schematically illustrating a front portion of the image forming unit used in the first exemplary embodiment of the present invention, when viewed from the left side.

FIG. 3 is a sectional view schematically illustrating a front portion of the image forming unit 26Y, when viewed from the left side. The image forming unit 26Y is symmetrical in the front-rear direction (the left-right direction in FIG. 3, and the direction intersecting with the sheet surface in FIGS. 1 and 2). The rear-side configuration of the image forming unit 26Y is the same as the front-side configuration of the image forming unit 26Y, and thus descriptions thereof will be omitted.

As illustrated in FIG. 3, the photoconductor drum 34Y includes a drum rotating shaft 36, and is rotatably supported by a side plate 96 of a photoconductor drum side casing 92 through the drum rotating shaft 36. Here, the photoconductor drum side casing 92 and the above described developing device side casing 202 (see, e.g., FIG. 2) may approach each other or may be separated from each other by, for example, a configuration such as connection through a hinge (not illustrated), or the like.

A guide hole 98 is formed in the side plate 96. A portion of the developing roller 220 is inserted into the guide hole 98. Specifically, a roller rotating shaft 226 of the developing roller 220 to be described below is inserted. The guide hole is an elongated hole extending in a direction from the developing roller 220 toward the photoconductor drum 34Y, and guides the developing roller 220 so that the developing roller 220 is moved in a direction toward or away from the photoconductor drum 34Y.

The above described developing roller 220 includes a cylindrical member 222 as a developer holding member, and a flange member 224 mounted at the front side of the cylindrical member 222. An outer side (the right end portion side) of the flange member 224 is used as the roller rotating shaft 226, and the roller rotating shaft 226 is rotatably attached to the developing device side casing 202 through a bearing 228. The cylindrical member 222 holds the developer on the outer circumferential surface thereof.

The image forming unit 26Y further includes a bearing 400. The bearing 400 supports the developing roller 220 so that the developing roller 220 may move in a direction toward or away from the photoconductor drum 34Y, and may be rotatable. The bearing 400 is mounted on the side plate 96.

The bearing 400 includes an outer ring member 410 and an inner ring member 412. The outer ring member 410 has a ring shape and is fixed to the side plate 96.

The inner ring member 412 has a ring shape and rotatably supports the roller rotating shaft 226 (the developing roller 220). More specifically, the inner ring member 412 is made of a resin having a low sliding resistance, and has an inner circumferential surface formed as a sliding surface. The inner circumferential surface rotatably supports the roller rotating shaft 226. The inner ring member 412 is disposed inside the outer ring member 410.

Figure 5A:
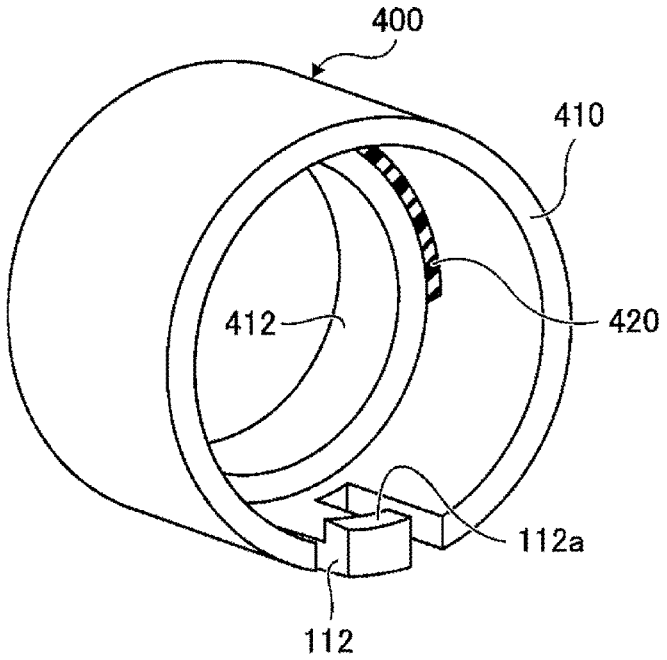
Figure 5B:
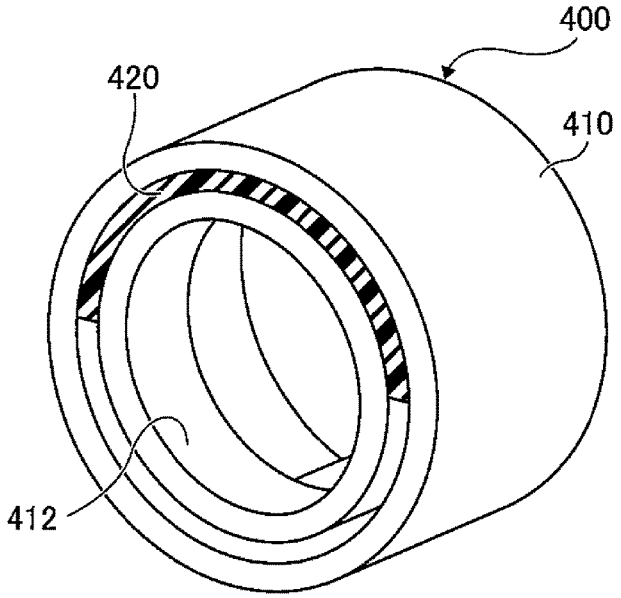

The bearing 400 further includes a viscoelastic body 420 (see, e.g., FIGS. 5A and 5B). That is, the viscoelastic body 420 is provided in the bearing 400. More specifically, the viscoelastic body 420 is mounted to be interposed between the outer ring member 410 and the inner ring member 412. The viscoelastic body 420 has a curved shape similar to a shape obtained by cutting out a portion of a cylinder, for example, a shape occupying the half of a space formed at the photoconductor drum 34Y side between the inner circumferential surface of the outer ring member 410 and the outer circumferential surface of the inner ring member 412. As a specific material of the viscoelastic body 420, for example, a thermoplastic elastomer or the like such as a styrene-based, olefin-based, vinyl chloride-based, urethane-based, or amide-based material may be used, and the viscoelastic body 420 may be made of a material containing any one of polyimide, polyethylene terephthalate, polyoxymethylene resin, or polyacetal resin.

The outer ring member 410 and the inner ring member 412 are made of a resin that is hardly elastically deformed as compared to the viscoelastic body 420. The outer ring member 410, the inner ring member 412, and the viscoelastic body 420 are integrally molded, for example.

The image forming unit 26Y further includes a leaf spring member 110 used as an urging unit. The leaf spring member 110 is provided in the outer ring member 410. More specifically, one end portion side of the leaf spring member 110 is fixed to the inner circumferential surface of the outer ring member 410. The other end portion side of the leaf spring member 110 is in contact with the roller rotating shaft 226. The leaf spring member 110 urges the developing roller 220 toward the photoconductor drum 34Y side so that the photoconductor drum 34Y and the developing roller 220 approach each other.

As the urging unit, instead of the leaf spring member 110, an urging portion 112 (see, e.g., FIGS. 5A and 5B) integrally formed with the outer ring member 410 may be used. The urging portion 112 is made of, for example, an elastically deformable resin, and includes a pressing portion 112*a* (see, e.g., FIGS. 5A and 5B) that has a shape like, for example, a snap fit, and comes in contact with the roller rotating shaft 226 to press the roller rotating shaft 226.

In the image forming unit 26Y configured as described above, in the bearing 400, when one of the outer ring member 410 and the inner ring member 412 is fixed and the other of the outer ring member 410 and the inner ring member 412 is moved, the viscoelastic body 420 is elastically deformed, so that a positional relationship between the outer ring member 410 and the inner ring member 412 is changed.

In the image forming unit 26Y configured as described above, due to urge by the leaf spring member 110, the viscoelastic body 420 may be deformed and crushed to be pressed and collapsed by the inner circumferential surface of the outer ring member 410. Then, the repulsive force of the viscoelastic body 420 caused by deformation of the viscoelastic body 420, the own weight applied to the developing roller 220, and the pressing force by the leaf spring member 110 are balanced.

Here, the viscoelastic body 420 is deformed according to a distance G between the photoconductor drum 34Y and the developing roller 220 (hereinafter, referred to as a DRS). For example, when the developer enters between the photoconductor drum 34Y and the developing roller 220, the distance between the photoconductor drum 34Y and the developing roller 220 is increased due to the entering of the developer, thereby deforming the viscoelastic body 420.

In the image forming unit 26Y configured as described above, a change of the DRS is absorbed by the deformation of the viscoelastic body 420, and thus a development unevenness caused by the DRS change is suppressed.

Meanwhile, since the image forming unit 26Y has the viscoelastic body 420, when the viscoelastic body 420 is deteriorated, or is excessively deformed, the DRS may be largely changed, and at least one of a maximum value and a minimum value of the DRS may not fall within a range required for suppressing the density unevenness. Thus, the image forming unit 26Y includes a distance regulating mechanism 800 that regulates the maximum value and the minimum value of the DRS so that the DRS may fall within a predetermined range. Here, the distance regulating mechanism 800 is an example of a distance regulating unit.

Meanwhile, the distance regulating mechanism 800 to be described below regulates both the maximum value and the minimum value of the DRS. However, the distance regulating mechanism 800 may regulate at least one of the maximum value and the minimum value of the DRS.

The distance regulating mechanism 800 includes the above described bearing 400 as a portion thereof, and also includes the above described viscoelastic body 420 included in the bearing 400 as a portion thereof. That is, the viscoelastic body 420 included in the distance regulating mechanism 800 is provided in the bearing 400.

Figure 4A:
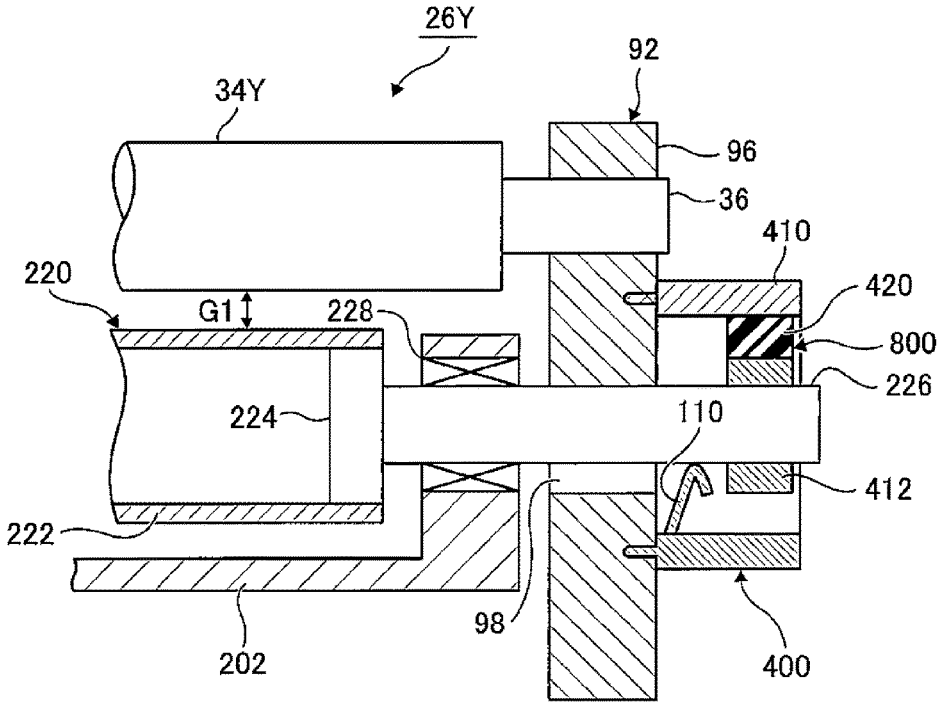
Figure 4B:
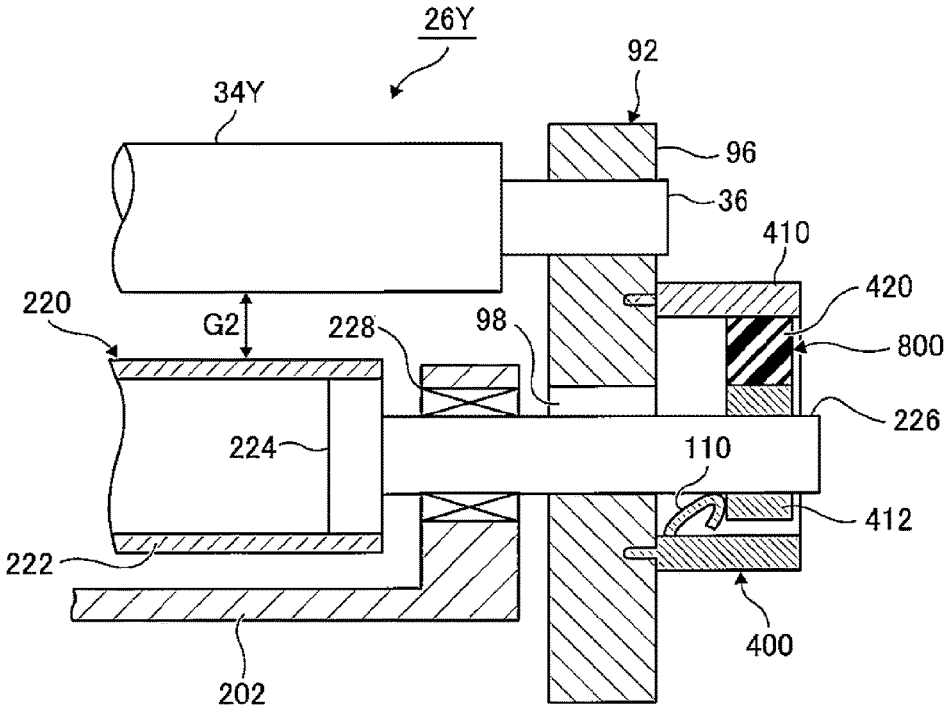

FIGS. 4A and 4B are views for describing an operation of the distance regulating mechanism 800, in which FIG. 4A illustrates the distance regulating mechanism 800 when the DRS is minimized, and FIG. 4B illustrates the distance regulating mechanism 800 when the DRS is maximized.

As illustrated in FIG. 4A, when the roller rotating shaft 226 of the developing roller 220 comes in contact with the end portion of the guide hole 98 at the photoconductor drum 34Y side, the developing roller 220 may not further approach the photoconductor drum 34Y from this position even by being urged by the leaf spring member 110. As described above, the distance regulating mechanism 800 brings the developing roller 220 into contact with the end portion of the guide hole 98 at the photoconductor drum 34Y side to regulate the minimum value of the DRS. Here, G1 in FIG. 4A indicates the minimum value of the DRS.

As illustrated in FIG. 4B, when the roller rotating shaft 226 of the developing roller 220 comes in contact with the end portion of the guide hole 98 at the side opposite to the photoconductor drum 34Y, the developing roller 220 may not further move away from the photoconductor drum 34Y from this position. In this manner, the distance regulating mechanism 800 brings the developing roller 220 into contact with the end portion of the guide hole 98 at the side opposite to the photoconductor drum 34Y to regulate the maximum value of the DRS. Here, G2 in FIG. 4B indicates the maximum value of the DRS.

FIGS. 5A and 5B are views illustrating the bearing 400. As illustrated in FIGS. 5A and 5B, the bearing 400 includes the outer ring member 410, the inner ring member 412, the viscoelastic body 420, and the urging portion 112 as described above. Instead of the urging portion 112, the leaf spring member 110 (see, e.g., FIG. 3) may be used as described above.

Figure 6:
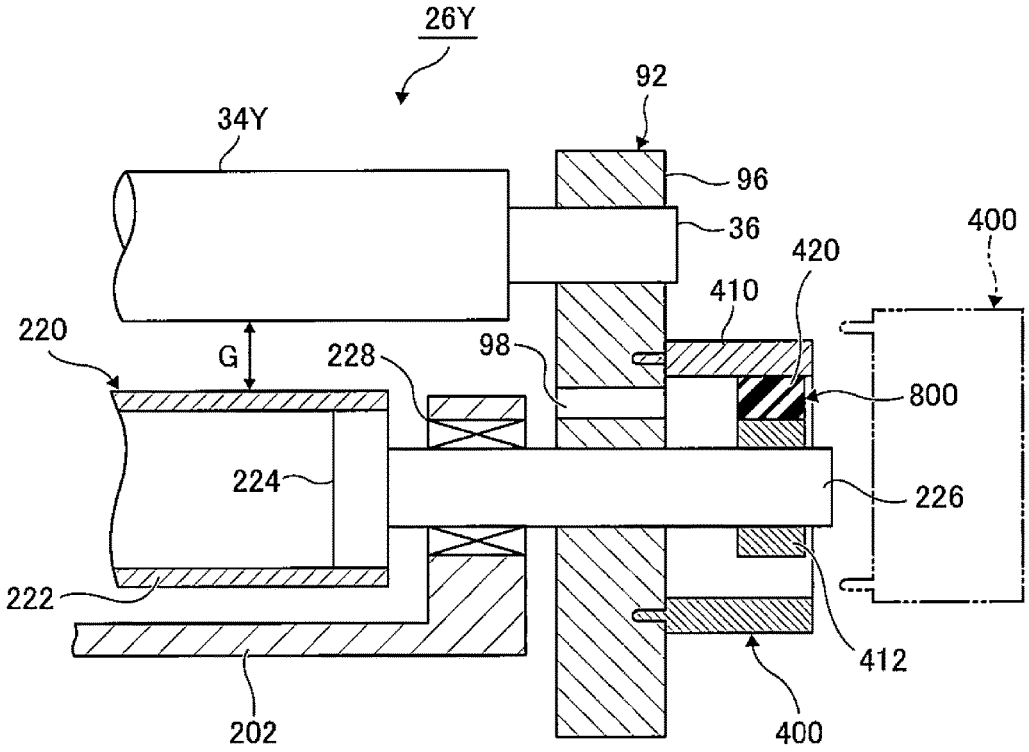
FIG. 6 is a sectional view schematically illustrating a front portion of an image forming unit used in a second exemplary embodiment of the present invention, when viewed from the left side.

FIG. 6 is a sectional view schematically illustrating a front portion of the image forming unit 26Y used in the image forming apparatus 10 according to a second exemplary embodiment of the present invention, when viewed from the left side. In the following descriptions, a difference between the second exemplary embodiment and the above described first exemplary embodiment will be described, and descriptions on some parts common to the second exemplary embodiment and the first exemplary embodiment will be omitted.

In the second exemplary embodiment, unlike the first exemplary embodiment, the leaf spring member 110 or the urging portion 112 as an urging unit is not included. The position where the bearing 400 is provided is different from the position where the bearing 400 is provided in the first exemplary embodiment as indicated by the two-dot chain line. Specifically, the bearing 400 is fixed to the side plate 96 to be disposed at a position farther from the photoconductor drum 34Y and closer to the developing roller 220 than in the first exemplary embodiment.

Since the bearing 400 is disposed as described above, the viscoelastic body 420 is crushed, and the developing roller 220 is urged in a direction away from the photoconductor drum 34Y by the repulsive force of the viscoelastic body 420. As the developing roller 220 is urged, the roller rotating shaft 226 is pressed against the end portion of the guide hole 98 at the side opposite to the photoconductor drum 34Y. In this state, the DRS is maximized. That is, in the second exemplary embodiment, the viscoelastic body 420 included in the distance regulating mechanism 800 urges the developing roller 220 to bring the developing roller 220 into contact with the end portion of the guide hole 98 at the side opposite to the photoconductor drum 34Y to regulate the maximum value of the DRS.

In the second exemplary embodiment as well, the distance regulating mechanism 800 brings the roller rotating shaft 226 of the developing roller 220 into contact with the end portion of the guide hole 98 at the photoconductor drum 34Y side to regulate the minimum value of the DRS.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier on which a latent image is developed;

a developing roller that is provided to face the image carrier to perform development for the latent image of the image carrier;

an urging unit that urges the image carrier and the developing roller so that the image carrier and the developing roller approach each other; and a distance regulating unit that includes a viscoelastic body that is deformed according to a change of a distance between the image carrier and the developing roller, and regulates at least one of a maximum value of the distance between the image carrier and the developing roller and a minimum value of the distance between the image carrier and the developing roller so that the distance between the image carrier and the developing roller falls within a predetermined range, wherein the distance regulating unit includes:

a side plate in which a guide hole is formed into which a portion of the developing roller is inserted, the guide hole guiding the developing roller so that the developing roller is movable in a direction toward or away from the image carrier, and a bearing that supports the developing roller to be movable in a direction toward or away from the image carrier as well as to be rotatable, and is provided on the side plate, and wherein the viscoelastic body is provided in the bearing.

2. The image forming apparatus according to claim 1, wherein the bearing includes an outer ring member fixed to the side plate, and an inner ring member that supports the developing roller and is provided inside the outer ring member, and the viscoelastic body is provided to be interposed between the outer ring member and the inner ring member.

3. The image forming apparatus according to claim 2, wherein the urging unit is provided in the outer ring member.

4. The image forming apparatus according to claim 3, wherein the distance regulating unit brings the developing roller into contact with an end portion of the guide hole at a side opposite to the image carrier to regulate the maximum value of the distance between the image carrier and the developing roller.

5. The image forming apparatus according to claim 2, wherein in a state where the viscoelastic body is contracted, the distance regulating unit brings the developing roller into contact with an end portion of the guide hole at the image carrier side to regulate the minimum value of the distance between the image carrier and the developing roller.

6. The image forming apparatus according to claim 5, wherein the distance regulating unit brings the developing roller into contact with an end portion of the guide hole at a side opposite to the image carrier to regulate the maximum value of the distance between the image carrier and the developing roller.

7. The image forming apparatus according to claim 2, wherein the distance regulating unit brings the developing roller into contact with an end portion of the guide hole at a side opposite to the image carrier to regulate the maximum value of the distance between the image carrier and the developing roller.

8. The image forming apparatus according to claim 2, wherein the viscoelastic body is made of a material containing any one of polyimide, polyethylene terephthalate, polyoxymethylene resin, and polyacetal resin.

9. The image forming apparatus according to claim 1, wherein in a state where the viscoelastic body is contracted, the distance regulating unit brings the developing roller into contact with an end portion of the guide hole at the image carrier side to regulate the minimum value of the distance between the image carrier and the developing roller.

10. The image forming apparatus according to claim 9, wherein the distance regulating unit brings the developing roller into contact with an end portion of the guide hole at a side opposite to the image carrier to regulate the maximum value of the distance between the image carrier and the developing roller.

11. The image forming apparatus according to claim 1, wherein the distance regulating unit brings the developing roller into contact with an end portion of the guide hole at a side opposite to the image carrier to regulate the maximum value of the distance between the image carrier and the developing roller.

12. The image forming apparatus according to claim 1, wherein the viscoelastic body is made of a material containing any one of polyimide, polyethylene terephthalate, polyoxymethylene resin, and polyacetal resin.

13. An image forming apparatus comprising:

an image carrier on which a latent image is developed;

a developing roller that is provided to face the image carrier to perform development for the latent image of the image carrier; and a distance regulating unit that includes a viscoelastic body that is deformed according to a change of a distance between the image carrier and the developing roller, and regulates at least one of a maximum value of the distance between the image carrier and the developing roller and a minimum value of the distance between the image carrier and the developing roller so that the distance between the image carrier and the developing roller falls within a predetermined range, wherein the distance regulating unit includes:

a side plate in which a guide hole is formed into which a portion of the developing roller is inserted, the guide hole guiding the developing roller so that the developing roller is movable in a direction toward or away from the image carrier, and a bearing that supports the developing roller to be movable in a direction toward or away from the image carrier as well as to be rotatable, and is provided on the side plate, and includes an outer ring member fixed to the side plate, and an inner ring member that supports the developing roller and is provided in the outer ring member, and wherein the viscoelastic body is provided to be interposed between the outer ring member and the inner ring member, and regulates the maximum value of the distance between the image carrier and the developing roller by urging the developing roller to bring the developing roller into contact with an end portion of the guide hole at a side opposite to the image carrier.

14. The image forming apparatus according to claim 13, wherein in a state where the viscoelastic body is contracted, the distance regulating unit brings the developing roller into contact with an end portion of the guide hole at the image carrier side to regulate the minimum value of the distance between the image carrier and the developing roller.

15. The image forming apparatus according to claim 14, wherein the viscoelastic body is made of a material containing any one of polyimide, polyethylene terephthalate, polyoxymethylene resin, and polyacetal resin.

16. The image forming apparatus according to claim 13, wherein the viscoelastic body is made of a material containing any one of polyimide, polyethylene terephthalate, polyoxymethylene resin, and polyacetal resin.

17. A bearing that is used to regulate at least one of a maximum value of a distance between an image carrier and a developing roller and a minimum value of the distance between the image carrier and the developing roller so that the distance between the image carrier and the developing roller falls within a predetermined range, and supports the developing roller to be movable in a direction intersecting with an axial direction of the developing roller as well as to be rotatable, wherein the bearing comprises:

an outer ring member;

an inner ring member that supports the developing roller and is provided inside the outer ring member;

a viscoelastic body that is provided between the outer ring member and the inner ring member, and is deformed according to a change of a positional relationship between the outer ring member and the inner ring member; and an urging unit that is provided in the outer ring member, and urges the inner ring member in a direction where the viscoelastic body is deformed.

18. The bearing according to claim 17, wherein the viscoelastic body is made of a material containing any one of polyimide, polyethylene terephthalate, polyoxymethylene resin, and polyacetal resin.

* * * * *